US010451058B2

(12) United States Patent
Popelka et al.

(10) Patent No.: US 10,451,058 B2
(45) Date of Patent: Oct. 22, 2019

(54) PUMP INSERT

(71) Applicant: Magna Powertrain Bad Homburg GmbH, Bad Homburg (DE)

(72) Inventors: Rolf Popelka, Mörfelden-Walldorf (DE); Boris Zinke, Kelkheim (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 192 days.

(21) Appl. No.: 15/397,851

(22) Filed: Jan. 4, 2017

(65) Prior Publication Data

US 2017/0211571 A1 Jul. 27, 2017

(30) Foreign Application Priority Data

Jan. 22, 2016 (DE) ..... 10 2016 200 893

(51) Int. Cl.
*F04C 2/344* (2006.01)
*F04C 18/344* (2006.01)

(52) U.S. Cl.
CPC ..... *F04C 2/344* (2013.01); *F04C 18/344* (2013.01); *F04C 2230/60* (2013.01); *F04C 2240/20* (2013.01); *F04C 2240/30* (2013.01); *F04C 2240/805* (2013.01)

(58) Field of Classification Search
CPC ..... F04C 2/344; F04C 18/344
USPC ... 418/229, 244, 260, 127, 24, 30, 259, 261, 418/152, 153
See application file for complete search history.

(56) References Cited

U.S. PATENT DOCUMENTS 3,656,869 A * 4/1972 Leonard ..... B62D 5/062 417/220
4,678,412 A * 7/1987 Dantlgraber ..... F04C 14/226 417/220
5,090,881 A * 2/1992 Suzuki ..... F04C 14/226 418/26
5,538,400 A * 7/1996 Konishi ..... F04C 14/226 417/220

FOREIGN PATENT DOCUMENTS

| | | | |
|---|---|---|---|
| CN | 103032308 | A | 4/2013 |
| DE | 102011055020 | A1 | 5/2012 |
| EP | 0385211 | A1 | 9/1990 |
| EP | 1820935 | A1 | 8/2007 |
| WO | WO2009036723 | A1 | 3/2009 |

OTHER PUBLICATIONS

Search Report dated Jun. 19, 2018 in corresponding Chines Patent Application No. 2017100439845.

* cited by examiner

*Primary Examiner* — Deming Wan
(74) *Attorney, Agent, or Firm* — Dickinson Wright PLLC

(57) ABSTRACT

A pump insert without a dedicated housing includes a first pressure plate, a cam ring, a rotor, a second pressure plate, and radially displaceable vanes arranged in slots of the rotor and which run with a vane upper edge thereof engaging a contour of the cam ring during rotation of the rotor. The cam ring includes stagnation point protrusions which are configured as separate, moveable components fastened to the cam ring.

7 Claims, 2 Drawing Sheets

PUMP INSERT

CROSS-REFERENCE TO RELATED APPLICATIONS

This application claims the benefit and priority of German Application No. DE 102016200893.5 filed Jan. 22, 2016. The entire disclosure of the above application is incorporated herein by reference.

FIELD

The present disclosure relates generally to pump inserts without a dedicated casing which are also referred to as cartridge pumps. More particularly, the present disclosure is directed to a cartridge pump including a first pressure plate, a cam ring, a rotor, a second pressure plate, and radially displaceable vanes arranged in slots formed in the rotor, wherein the vanes run with the vane upper edge thereof along a contour of the cam ring during rotation of the rotor, and wherein the cam ring has stagnation point protrusions.

BACKGROUND

This section provides background information related to the present disclosure which is not necessarily prior art to the inventive concepts disclosed and claimed.

DE102011055020A1 discloses a pump insert without a dedicated housing. Such pump inserts, also called cartridge pumps, are used, for example, in gear casings.

In order to achieve sufficient charging of the pump, the ends of the suction tract have to be closed. For this purpose, protrusions are mounted on a cam ring of the pump, the protrusions engaging in casing recesses.

In the prior art, the protrusions, which serve as the termination of the suction tract and form stagnation points, are sintered or forged onto the cam ring. By this means, the shaping and the adaptation to the customer's casing component are restricted. Problems with the machining of the end surfaces particularly also occur with an increasing size of the protrusions. Furthermore, it has to be ensured during the assembly that the protrusions do not pull any chips away from the casing component and the gear casing is not damaged. This may result in more complicated constructions at the pump pressure plates. Furthermore, machining of the cartridge space in the region of the stagnation point protrusions cannot be avoided in order to ensure the mountability of the pump and the effectiveness of the stagnation point protrusions.

It is therefore the object of the invention to address the shortcomings of the prior art and provide a cartridge pump which simplifies the assembly but nevertheless has a precise seat and good closure properties.

SUMMARY

This section provides a general summary of the disclosure, and is not a comprehensive disclosure of its full scope or all of its features.

The object is achieved by a pump insert without a dedicated housing, comprising a first pressure plate, a cam ring, a rotor, a second pressure plate, and radially displaceable vanes arranged in slots of the rotor, wherein the vanes run with the vane upper edge thereof along the contour of the cam ring during rotation of the rotor, and wherein the cam ring has stagnation point protrusions which are designed as separate components made from plastic.

By use of plastics stagnation point protrusions, the production of the cam ring, the flange and the pressure plate is simplified and in addition the assembly of the pump is improved. As a result, more flexible adaptation to a customer interface, i.e. to the recess in the gearing, is possible. Better sealing of the suction tract ends also takes place.

It is advantageous that the stagnation point protrusions bear against the unmachined casing wall of the gear casing accommodating the pump insert.

The stagnation point protrusions are advantageously fastened with fastening means in press-in openings formed in the cam ring.

It is advantageous that the fastening means are designed as a pin or clip or mushroom-shaped pin, wherein the stagnation point protrusions have a crescent-shaped or a rectangular flat design.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
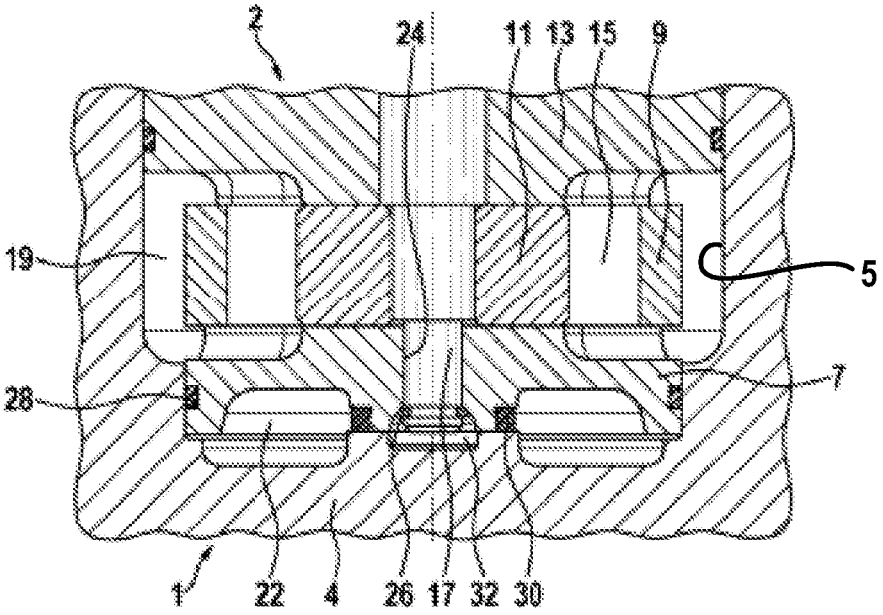
FIG. 1 shows a partial cutout of a conventional pump insert installed in a gear casing.

FIG. 1 illustrates a pump 1 in section. The pump 1, commonly referred to as a cartridge pump, comprises a pump insert 2 which, for the illustration of the pump 1, is installed in a separate gear casing 4. In this example, the gear casing 4 contains a stepped blind hole bore in which the pump insert 2 is arranged.

The pump insert 2 is configured to include a first pressure plate 7, a contour or cam ring 9, a rotor 11, and a second pressure plate 13. Radially displaceable vanes 15 are arranged in slots formed in the rotor 11 and are configured to run with the vane upper edge thereof along the contour of the cam ring 9 during rotation of the rotor 11. In a manner corresponding to the contour of the cam ring 9, cells arise here between two adjacent vanes 15, with these cells increasing or reducing in size depending on the contour section and, in the process, sucking up oil and ejecting same again.

The rotor 11 is driven by a shaft 17 which is therefore also referred to as the drive shaft 17. When the shaft 17 drives the rotor 11, oil is conveyed out of a suction space 19 into a pressure space 22 of the pump 1. The pressure space 22 is formed between the first pressure plate 7 and the gear casing 4.

In this example, the drive shaft 17 is of stepped design and, inter alia, is mounted in a bearing recess 24 of the first pressure plate 7. At its free end, the drive shaft 17 projects into a low-pressure space 32 which is sealed off from the pressure space 22. The first pressure plate 7 is held captively on the drive shaft 17 in the axial direction together with the remaining parts of the pump insert 2 by means of a snap ring 26. The snap ring 26 engages in an annular groove on the drive shaft 17.

The pressure space 22 is sealed off from the suction space 19 by an O-ring 28. In order to seal off the pressure space 22 from the low-pressure space 32, a relatively complicated axial seal 30, which is also referred to as a combination seal, is required.

In the prior art, stagnation point protrusions are sintered or forged onto the cam ring 9. This firstly permits only the overcoming of a relatively short distance between cam ring and casing since, in the case of longer designs, problems occur during the finishing of the cam rings. In addition, it has to be ensured at the pressure plate that the stagnation point protrusions are covered.

Figure 2:
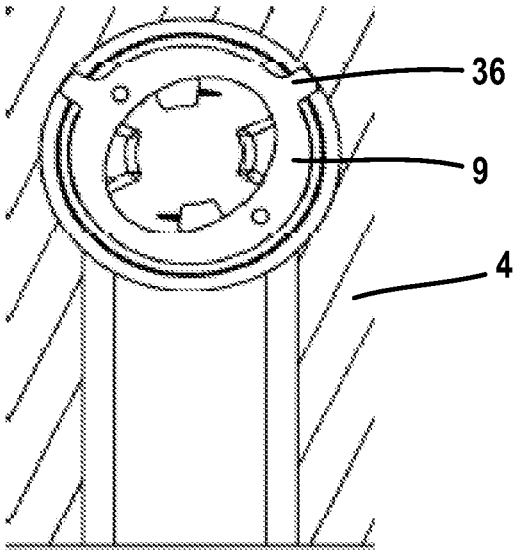
FIG. 2 shows a conventional cam ring in a top view.

The stagnation point protrusions 36 on the cam ring 9 can be seen in FIG. 2 in a view from above of the recess in the casing 4.

Figure 3:
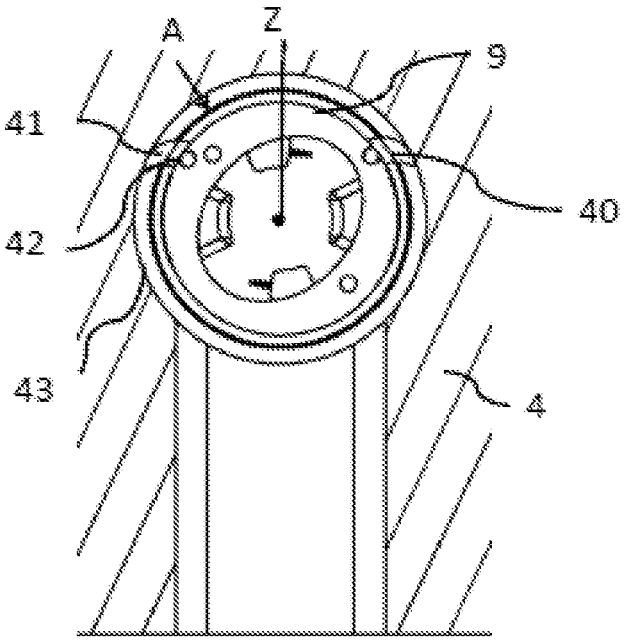
FIG. 3 shows a solution according to the invention.

A solution according to the invention is illustrated in FIG. 3. In particular, FIG. 3 illustrates the cam ring 9 now equipped with stagnation point protrusions 40 that provide distinct improvements over the prior art.

In this non-limiting example, the stagnation point protrusions 40 are realized by cost-effective plastics injection moulded parts 41. These plastics injection moulded parts 41 are connected to the cam ring 9 via press-in openings 42.

During the assembly of the pump 1, the plastics injection moulded parts 41 are inserted into the cam ring 9 and are mounted movably in the press-in openings 42. As a result, the stagnation point protrusions 40 can be retracted during the mounting of the pump insert 2 into casing 4 in order not to be damaged or not to damage the casing. In one embodiment, the stagnation point protrusions move out of the plane of the image in FIG. 3, i.e. perpendicularly to the delimiting casing 4. Alternatively, a form is also possible in which the plastics injection moulded parts 41 are rotatable about the press-in opening 42 in the direction of the central axis Z.

During operation, the plastics injection moulded parts 41 are placed by the flow against the unmachined casing wall 43 and delimit the suction channel. With this construction, relatively large distances "A" can be realized between cam ring 9 and casing 4.

The region of the stagnation point protrusions 40 does not have to be machined in the gear casing, and the risks of damage of the casing and production of chips are minimized.

The plastics injection moulded parts 41 are designed as plastics plates formed in a crescent shape and, at the end which is fastenable to the cam ring 9, have a simple pin or a clip or a mushroom-shaped pin 44. The crescent shape may also be replaced by a rectangle.

Figure 4:
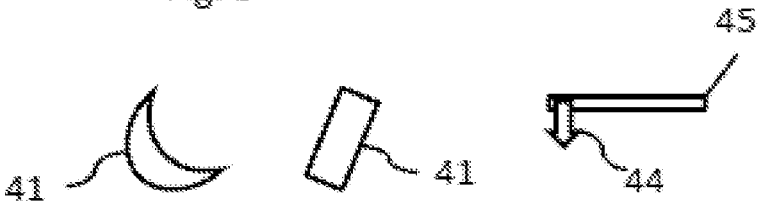
FIG. 4 shows an alternative embodiment.

It is schematically illustrated in FIG. 4 how the plastics injection moulded part 41 with a mushroom-shaped pin 44 looks in section. The edge 45 of the flat plastics/injection moulded part 41 bears against the unmachined casing wall 43 of the gear casing 4.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE SKINS

1 Pump
2 Pump insert
4 Gear casing
5 Stepped blind hole bore
7 First pressure plate
9 Contour ring/cam ring
11 Rotor
13 Second pressure plate
15 Vane
17 Shaft
19 Suction space
22 Pressure space
24 Bearing recess
26 Snap ring
28 O-ring
30 Axial seal
32 Low-pressure space
36 Stagnation point protrusions
40 Stagnation point protrusion
41 Plastics injection moulded part
42 Press-in openings
43 Unmachined casing wall
44 Mushroom-shaped pin
45 Edge
A Distance between cam ring and casing wall

The invention claimed is:

1. A pump insert without a dedicated casing, comprising a first pressure plate, a cam ring, a rotor, a second pressure plate, and radially displaceable vanes arranged in slots formed in the rotor, which radially displaceable vanes run with a vane upper edge thereof along a contour of the cam ring during rotation of the rotor, wherein the cam ring has stagnation point protrusions, wherein that the stagnation point protrusions are configured as separate, retractable components, wherein the stagnation point protrusions are disposed in press-in openings formed in the cam ring, and wherein the stagnation point protrusions are fastened within the press-in opening via one of a pin, a clip, and a mushroom-shaped pin.

2. The pump insert according to claim 1, wherein the stagnation point protrusions bear against a casing wall of a gear casing accommodating the pump insert.

3. The pump insert according to claim 1, wherein the stagnation point protrusions have a crescent-shaped, flat design.

4. The pump insert according to claim 1, wherein that the stagnation point protrusions have a rectangular flat design.

5. The pump insert according to claim 1, wherein the stagnation point protrusions are made from plastic.

6. A pump comprising:

a gear casing defining a blind bore; and a cartridge pump inserted into the blind bore, the cartridge pump including a first pressure plate, a rotor defining vane slots, a cam ring, a second pressure plate, and radially displaceable vanes disposed within the vane slots formed in the rotor such that an upper edge of the radially displaceable vanes runs along a contour of the cam ring during rotation of the rotor, wherein the cam ring includes stagnation point protrusions configured as separate, retractable components, wherein the stagnation point protrusions are disposed in press-in openings formed in the cam ring, and wherein the stagnation point protrusions are secured within the press-in openings via a fastener;

wherein the stagnation point protrusions are secured within the press-in openings via one of a pin, a clip, and a mushroom-shaped fastener.

7. The pump according to claim 6, wherein the stagnation point protrusions are plastic components configured to bear against a casing wall within the blind bore of the gear casing.

* * * * *